United States Patent [19]

Cortesi

[11] Patent Number: 4,798,363

[45] Date of Patent: Jan. 17, 1989

[54] CONTAINER WITH LINING BAG DISPENSER

[76] Inventor: Roy L. Cortesi, P.O. Box 453, Greenville, Miss. 39502

[21] Appl. No.: 111,634

[22] Filed: Oct. 23, 1987

[51] Int. Cl.[4] ..... A63B 55/04

[52] U.S. Cl. ..... 248/97; 220/407

[58] Field of Search ..... 248/99, 97, 98, 101, 248/DIG. 7; 220/404, 407; 141/314, 391; 53/390; 383/33

[56] References Cited

U.S. PATENT DOCUMENTS

| | | | |
|---|---|---|---|
| 2,801,809 | 8/1957 | Glaner | 242/55.2 U X |
| 3,451,453 | 6/1969 | Heck | 220/407 X |
| 3,800,503 | 4/1974 | Maki | 220/404 X |
| 3,800,994 | 4/1974 | Bowen | 220/404 |
| 3,964,630 | 6/1976 | Getz | 220/404 |
| 4,319,694 | 3/1982 | Nehrbass | 220/404 X |
| 4,364,490 | 12/1982 | Lang | 220/404 X |

FOREIGN PATENT DOCUMENTS

| | | | |
|---|---|---|---|
| 1204203 | 9/1970 | United Kingdom | 220/407 |
| 2080248 | 2/1982 | United Kingdom | 248/99 |

*Primary Examiner*—J. Franklin Foss

*Attorney, Agent, or Firm*—Berman, Aisenberg & Platt

[57] ABSTRACT

A wastebasket is provided with a roll of liner bags below the bottom of the wastebasket. The bags are fed through a slot in the bottom to permit replacement of a first bag with a succeeding bag in the roll. When a full bag is removed from the container, the succeeding bag is automatically pulled into the enclosure, and it may be removed by simply tearing at a perforated line.

1 Claim, 1 Drawing Sheet

CONTAINER WITH LINING BAG DISPENSER

FIELD OF THE INVENTION

This invention relates to containers and, in particular, to a container having a dispenser for bags which line the container.

BACKGROUND ART

A known wastebasket comprises an enclosure formed by upstanding sidewalls and a bottom. It is known to line the enclosure with a plastic bag and to place objects into the bag so that the enclosure remains clean and to permit easy removal of the objects after the enclosure has been filled. Typically, plastic bags are used which are slightly longer than the enclosure to permit them to be closed at the top for sanitary purposes.

The plastic bags are usually supplied in rolls, and the bottom of one bag is secured to the top of a succeeding bag by a perforated line in the plastic material.

Installation of a bag in the prior art is accomplished by removing a single bag from the roll of bags, placing the bag into the container from the top of the container, and expanding the bag to allow objects to be placed in it. This is quite time consuming and awkward because of the many steps required to replace the bag.

SUMMARY OF THE INVENTION

In accordance with the invention, a wastebasket, or other container, is provided with a spindle, preferably located below the bottom wall of the container. The spindle is designed to carry a roll of bags of a size appropriate for use with that container. The bottom wall has means for allowing the collapsed bags as they come off of the roll to pass through the bottom wall, and in the preferred embodiment, the bottom wall has a slot in it.

To install a bag, one removes the spindle, which is preferably spring-loaded, places a roll of plastic bags on the spindle, and replaces the spindle. Then, a bag is threaded through the slot, pulled upwardly, opened and the top edge of the bag is folded over the top edge of the container. After the bag is filled, the upper edge of the bag is gathered together, and the bag full of objects is lifted out of the container. As the bag is pulled out of the container, the next succeeding bag on the roll will be automatically pulled through the slot, and upwardly throughout the height of the container. Then, one simply grasps the succeeding bag with the free hand and tears it from the full bag. The full bag may then be placed on the floor, and the upper edge of the succeeding bag is folded over the upper edge of the container. The full bag is then disposed of in the normal manner.

Because an ordinary roll of plastic bags has a large number of bags on it, it is not necessary to replace the roll for several weeks, or even months.

It is an object of this invention to provide an improved container wherein a roll of bags is stored in the container for easy use.

Another object of this invention is to mount a roll of bags for use with a container below the bottom wall of the container.

DETAILED DESCRIPTION OF THE INVENTION

Figure 1:
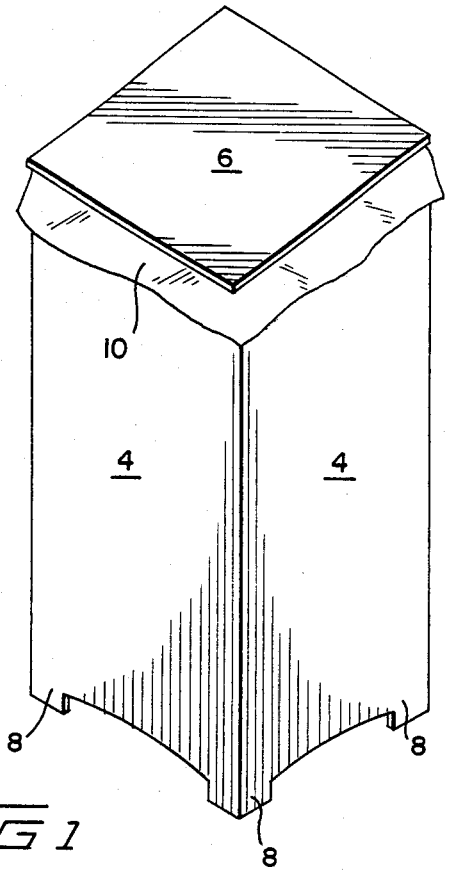
FIG. 1 is a perspective view of an improved wastebasket in accordance with the invention.

FIG. 1 shows a wastebasket 2 in accordance with the invention having side walls 4, lid 6, and legs 8. The upper edge 10 of a plastic bag is folded over the upper edge of the side walls 4.

Figure 2:
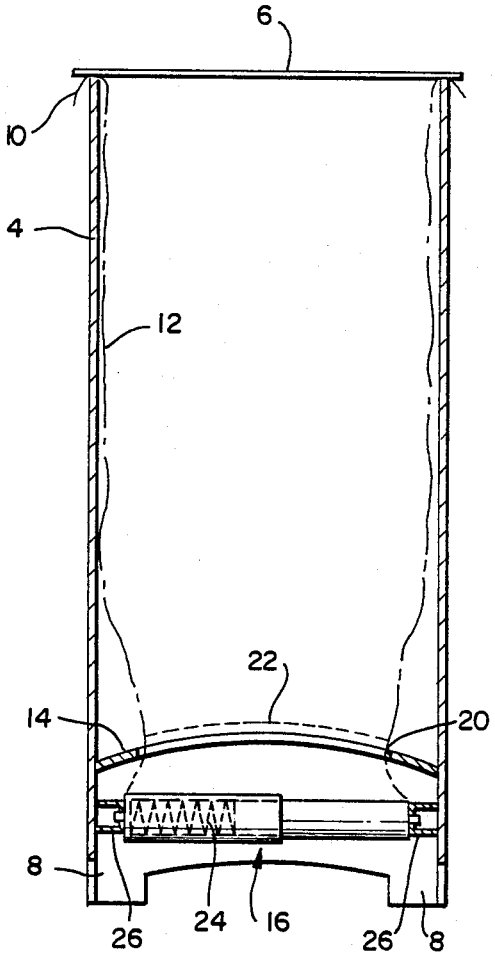
FIG. 2 is a longitudinal cross-section of the wastebasket shown in FIG. 1.
Figure 3:
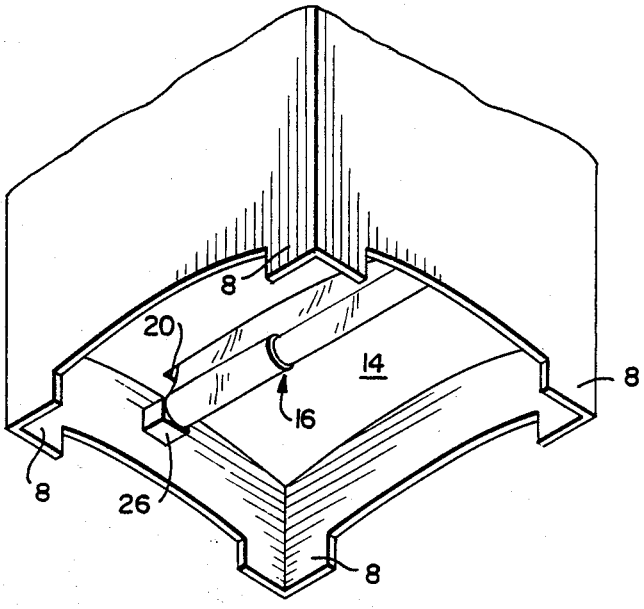
FIG. 3 is a bottom perspective of the wastebasket shown in FIG. 1.
Figure 4:
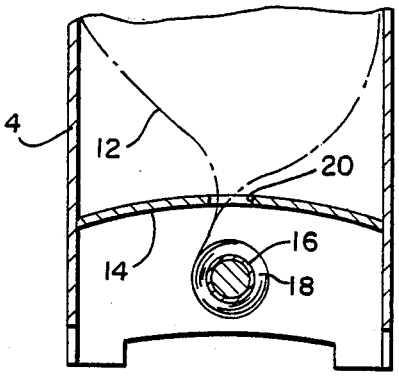
FIG. 4 is a partial longitudinal cross-section of the wastebasket shown in FIG. 1 perpendicular to the cross-section of FIG. 2.

With reference to FIGS. 2, 3 and 4, an enclosure formed by side walls 4 is filled by bag 12 for receiving objects (not shown). Bag 12 rests on bottom 14 of wastebasket 2. A spindle 16 mounts a roll 18 of bags, such as plastic bags, and collapsed bags are threaded through a slot 20 in bottom 14 as they are pulled off of roll 18.

It will be appreciated that the roll 18 of bags 12 comprises a series of bags connected to each other by a perforated line 22, whereby the bottom of one bag is connected to the top of a succeeding bag.

In operation, when bag 12 is full, lid 6 is raised, and upper edge 10 of bag 12 is gathered to allow it to be grasped in one hand. Then, bag 12 is lifted from the container thus drawing a subsequent bag along with it. When the bottom of bag 12 emerges from the container, the free hand is used to grasp the succeeding bag and remove it from the bottom of bag 12 by tearing at perforated line 22. Then, bag 12 is placed on the floor and the upper edge of the succeeding bag is folded over the top of the side walls 4.

Spindle 16 preferably includes two telescoping parts urged apart from each other by a spring 24. The ends of the spindle 16 are received in bosses 26 to support the spindle. When the roll of bags is exhausted, spindle 16 is removed by compressing spring 24, a new roll of bags is placed on the spindle, and it is replaced. Then, the first bag of the roll is pulled through slot 20 to place the first bag into the operational position shown in FIG. 2. The above-described procedure is then followed until the roll of bags is again exhausted, which is typically a substantial period of time.

Bottom 14 is preferably curved so as to be convex to the interior of the container to facilitate the above-described operations. For example, threading the first bag through slot 20 is facilitated by provided additional space between the roll and the slot, while still maintaining a compact profile for the container.

It will be appreciated that a unique arrangement has been described whereby plastic (or other material) liners for a container are easily and efficiently replaced.

What is claimed is:

1. A wastebasket for using easily replaced inner liners to receive material, said wastebasket comprising an elongate sidewall forming an elongate enclosure, said enclosure being open at opposed ends, said sidewall comprising a lower edge having portions for engaging and resting on a generally flat floor and portions forming openings between said lower edge and said floor, a lower wall extending substantially completely across said enclosure and spaced from said lower edge by a distance less than that between said lower wall and an upper edge of said sidewall, said lower wall being convex with respect to said upper edge and comprising means forming a slot therein, said slot being centrally located in said lower wall with respect to one transverse dimension of said enclosure and extending a majority of the way across said lower wall in a perpendicular transverse dimension, one axle for revolvingly mounting a roll of said inner liners, and mounting means for removably mounting opposed ends of said axle, wherein said mounting means is located between said lower wall and said lower edge, and a lid for removably covering said end formed by said upper edge.

* * * * *

UNITED STATES PATENT OFFICE
CERTIFICATE OF CORRECTION

Patent No. 4,798,363 Dated January 17, 1989

Inventor(s) Roy L. CORTESI

It is certified that error appears in the above-identified patent and that said Letters Patent is hereby corrected as shown below:

Column 3, line 3, "one" should read --an--.

Signed and Sealed this

First Day of August, 1989

*Attest:*

*Attesting Officer*

DONALD J. QUIGG

*Commissioner of Patents and Trademarks*